US005316109A

United States Patent [19]

Thomas et al.

[11] Patent Number: 5,316,109

[45] Date of Patent: May 31, 1994

[54] LOCKDOWN APPARATUS WITH INTERMEDIATE MEMBRANE

[75] Inventors: Richard H. Thomas; Gerald K. Langreck, both of Phillips, Wis.

[73] Assignee: Marquip Inc., Phillips, Wis.

[21] Appl. No.: 471,547

[22] Filed: Jan. 29, 1990

[51] Int. Cl.[5] ..... B61H 7/00

[52] U.S. Cl. ..... 188/41; 188/165; 188/67

[58] Field of Search ..... 188/41, 42, 74, 161, 188/165, 217, 249, 67

[56] References Cited

U.S. PATENT DOCUMENTS

| | | | |
|---|---|---|---|
| 1,814,841 | 7/1931 | Mosleh | 188/41 X |
| 1,925,081 | 9/1933 | Brett | 188/41 X |
| 2,723,015 | 11/1955 | Wellauer | 188/249 X |
| 3,330,384 | 7/1967 | Bertin et al. | 188/42 X |
| 3,840,095 | 10/1974 | Matson | 188/42 X |
| 4,627,214 | 12/1986 | Anderson et al. | 53/71 |

FOREIGN PATENT DOCUMENTS

| | | | |
|---|---|---|---|
| 1147857 | 4/1963 | Fed. Rep. of Germany | 188/217 |
| 2086346 | 5/1982 | United Kingdom | 188/67 |

*Primary Examiner*—Robert J. Oberleitner
*Assistant Examiner*—Lee W. Young
*Attorney, Agent, or Firm*—Andrus, Sceales, Starke & Sawall

[57] ABSTRACT

A lockdown apparatus for releasably locking a coaxially mounted series of tool heads in a slitter-scorer machine includes an elongate locking member movable into simultaneous engagement with locking surfaces on each of the tool heads and a flexible membrane interposed directly between the locking member and the locking surfaces which membrane is flexed into and out of direct locking engagement with the locking surfaces by movement of the locking member. The flexible membrane may be used with either a rotary or reciprocal locking member and, in either case, the flexible membrane may be secured against movement with respect to the tool heads when they are locked such that unavoidable longitudinal movement of the locking member will not disrupt the critically accurate locked positions of the tool heads. The rotary lockdown apparatus utilizes an elongate cam of the type known in the prior art and, in the reciprocal lockdown apparatus, the locking bar comprises the armature of a solenoid.

3 Claims, 4 Drawing Sheets

LOCKDOWN APPARATUS WITH INTERMEDIATE MEMBRANE

BACKGROUND OF THE INVENTION

The present invention relates to an apparatus for slitting and scoring corrugated paperboard sheet and similar materials and, in particular, to an improved apparatus for locking the slitting and scoring tool heads in operative position.

So-called "slitter-scorer" machines are well known in the art of corrugated paperboard handling and such machines include apparatus to slit and advancing sheet of corrugated paperboard and also provide score lines therein to facilitate subsequent folding in the construction of paperboard boxes and the like. Both slitting and scoring are accomplished by moving the corrugated sheet between pairs of rotatable cutting tools and scoring tools disposed in the path of the advancing sheet with one tool of each pair located on an opposite side of the sheet. Multiple pairs of slitting and scoring tools may be mounted coaxially and laterally spaced across the width of the sheet with scoring and slitting tools mounted on the same axis or with slitting tools and scoring tools each mounted on separate axis. When mounted on separate axis, either scoring or slitting may be performed first, i.e. upstream of the other slitting or scoring step.

In one prior art slitter-scorer machine shown in U.S. Pat. No. 4,627,214, each of a plurality of coaxially mounted slitting tools or scoring tools is attached to its own separate slitting (or scoring) head. The common shaft on which each coaxial group of slitting tools or scoring tools is mounted is driven to concurrently drive each of the tools mounted thereon. The tool heads for each group are slidably mounted on linear bearing ways which extend parallel to the drive shaft so that each slitting or scoring tool may be selectively positioned laterally across the width of the corrugated paperboard sheet. In addition, each tool head includes a servomotor or other suitable drive means including a driven pinion which cooperates with a linear rack which is also disposed parallel to the linear bearing ways and tool drive shaft. The servomotor drives the tool head and attached tool along the bearing ways and drive shaft to accurately locate the tool at the proper lateral position with respect to the sheet to be slit and scored. In a typical slitter-scorer, a plurality of upper and lower slitting head pairs and a plurality of upper and lower scoring head pairs are mounted on four substantially identical support assemblies, each comprising a drive shaft, linear bearing ways, and positioning rack. In addition, each assembly includes a lockdown apparatus comprising a locking bar also disposed parallel to the drive shaft, bearing ways and rack, which is movable into simultaneous locking engagement with each of the tool heads supporting a group of coaxially mounted tools to lock the heads in place once they have been properly positioned.

In the above identified U.S. patent, the disclosed lockdown apparatus includes a long generally cylindrical cam having an axially extending flat along the full length of an outer surface portion thereof. The cam is mounted to extend along each group of shaft-mounted tool heads in a position to engage identical locking surfaces on each of the heads after they have been driven laterally into selected operating positions. While unlocked, the cam is disposed with the flat spaced from the locking surfaces on the tool heads and, when the cam is rotated on its axis, the cylindrical outer surface engages the locking surfaces and locks the heads in position. This prior art lockdown apparatus has performed adequately, but exhibits two significant deficiencies. First of all, because each of the tool heads is slidable along the drive shaft which passes through the center of the rotary tool, virtually complete reliance is placed on the locking cam to retain this position. The cam, in turn, is mounted for rotation on its axis and, as a result, must be supported by rotary bearings. In order to maintain the required precision alignment between, for example, a pair of upper and lower rotary slitting tools, the slitting head and attached tool cannot be subject to lateral displacement along the drive shaft of more than 0.0005 inch. Unfortunately, the normal axial movement which occurs in virtually any type of cam-supporting rotary bearing assembly is substantially greater than the allowable tolerance. Thus, if the locking cam moves axially because of play in its supporting bearings, all of the tool heads which are locked by the cam will also move along their common drive shaft with the cam. The other problem in the prior art apparatus relates to inevitable wear between the cylindrical surface of the cam and the locking surfaces on the tool heads. To maintain an adequate locking force, the locking surfaces on the tool heads are provided with a high friction material which is, of course, engaged by the cam when it is rotated into its locking position. This frictional contact results in substantial wear and the consequent need for adjustment or repair in order to maintain an adequate lockdown force. Obviously, the engaging locking surfaces cannot be lubricated to reduce wear because the resultant decrease in friction between the engaging surfaces would also reduce the locking force holding the tool heads against lateral displacement along their drive shaft.

SUMMARY OF THE INVENTION

In accordance with the present invention, a lockdown apparatus for the tool heads of a slitter-scorer includes a flexible membrane disposed between the locking member or cam and the locking surfaces on the tool heads, which membrane is fixed against movement in the direction of tool head movement along the drive shaft. The flexible membrane may be moved into locking engagement with the locking surfaces utilizing a rotary cam apparatus of the type described in the prior art or with a reciprocably movable locking bar. In either case, high friction contact surfaces may be maintained between the locking surfaces and one side of the membrane and the total lack of relative movement therebetween precludes wear. In addition, in the rotary embodiment, the membrane may completely enclose the rotary cam such that the engaging surfaces of the cam and the other side of the membrane may be lubricated to reduce wear.

In a broad sense, the present invention may be applied to a lockdown apparatus for releasably locking various types of operating mechanisms in selected positions, which mechanisms are translatable in a linear path along a supporting track to any of a plurality of selected positions. In its most basic aspect, the lockdown apparatus of the present invention comprises a suitable locking surface on each of the linearly translatable operating mechanisms, a locking member mounted in a position parallel to the linear path and adjacent the locking surfaces in any of the selected positions to which the mechanisms may be moved, with said locking member being movable between an unlocked position in which it is spaced from the locking surfaces and a locked position in engagement with said surfaces. The flexible membrane is positioned between the locking surfaces and the locking member and is flexurally movable in response to direct engagement by the locking member into direct locking engagement with the locking surfaces. Various means may be utilized for moving the locking member between its locked and unlocked positions.

With the flexible membrane fixed against movement in the direction of the linear path of adjustable movement, the locking cam or other locking member on the opposite side of the membrane may be permitted to move axially along that membrane surface without displacing the operating mechanisms from their locked positions.

In the embodiment wherein the locking member comprises an elongate cam, the cam is preferably generally cylindrical in cross section and includes a cylindrical outer surface which is interrupted by an axially extending flat. Rotation of the cam on its axis positions the flat adjacent to, but spaced from, the locking surfaces in the unlocked position, and causes the cylindrical surface to engage the locking surfaces, via the intermediate membrane, in the locked position. Suitable bearing means are provided for rotatably supporting the cam for rotation and for supporting the flexible membrane in its fixed position. The membrane preferably substantially encloses the cam and is retained in direct engagement with the cam surface in the unlocked position, as well as the locked position.

In the preferred embodiment of the invention, the locking member comprises a rigid elongate locking bar which is coextensive with the linear path in which the operating mechanisms may be adjustably moved. The rigid locking bar is supported for reciprocal movement in a direction normal to the linear path. Means for moving the locking bar between its unlocked and locked positions includes resilient biasing means for holding the bar in the locked position and opposing means for overcoming the resilient bias and moving the locking bar into the unlocked position. The flexible membrane is disposed between the surface of the locking bar and the locking surfaces on the operating mechanisms. Preferably, the flexible membrane is rigidly attached to a rigid supporting base which is fixed against movement in the direction of linear movement of the operating mechanisms. The flexible membrane substantially encloses the locking bar in the supporting base such that there is direct engagement between the locking bar and one surface of the flexible membrane in both the locked and unlocked positions. The means for moving the locking bar, in the preferred embodiment, comprises a solenoid device in which the locking bar forms the armature of the solenoid and the resilient means biasing the bar into the locked position comprises a plurality of coil springs disposed between the locking bar and the supporting base, whereby actuation of the solenoid device causes the locking bar to move against the bias of the coil springs to the unlocked position.

DETAILED DESCRIPTION OF THE PREFERRED EMBODIMENT

Figure 1:
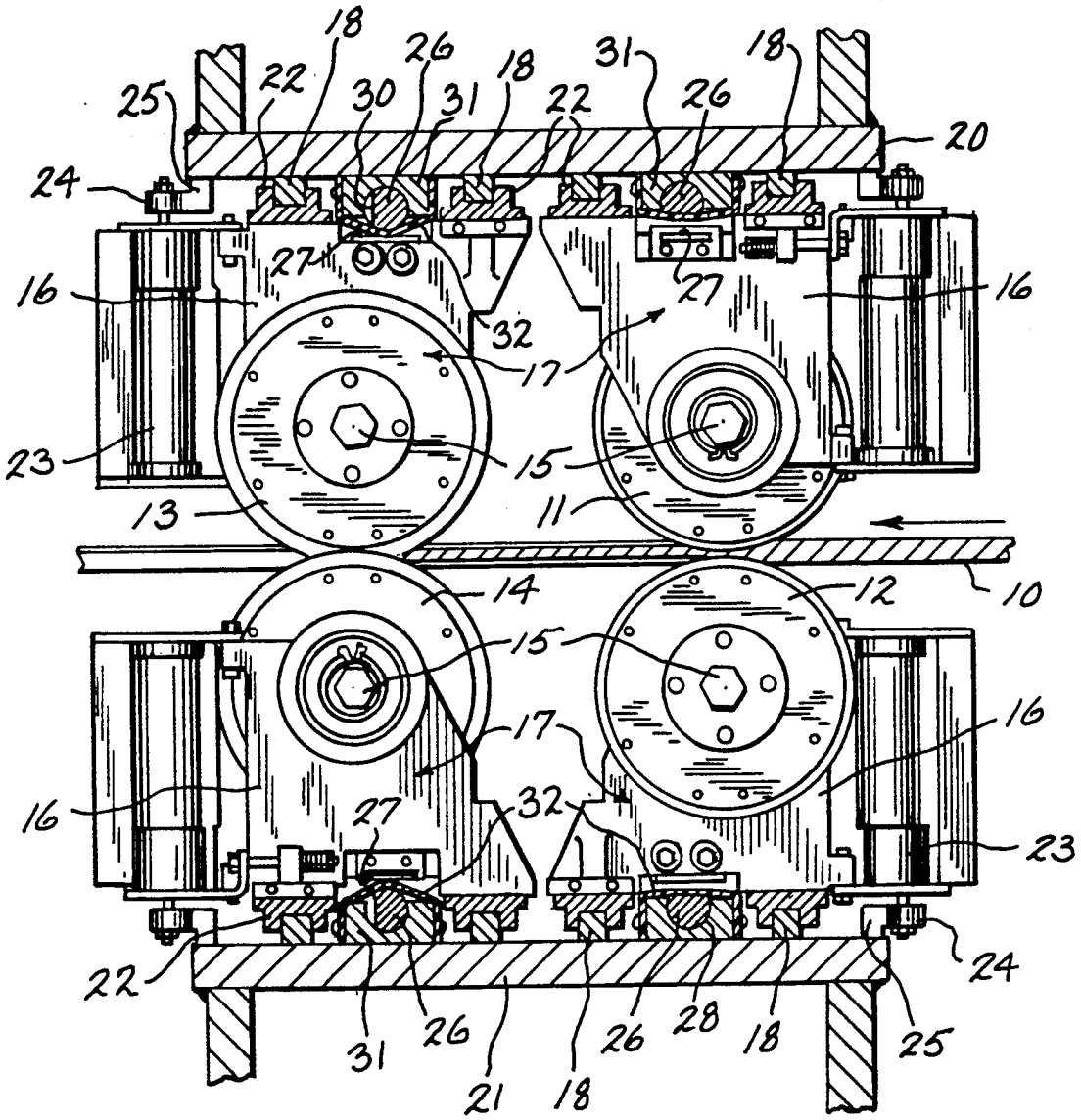
FIG. 1 is a side elevation, partly in section, of a slitter-scorer machine utilizing a lockdown apparatus with an intermediate membrane in accordance with one embodiment of the invention.
Figure 2:
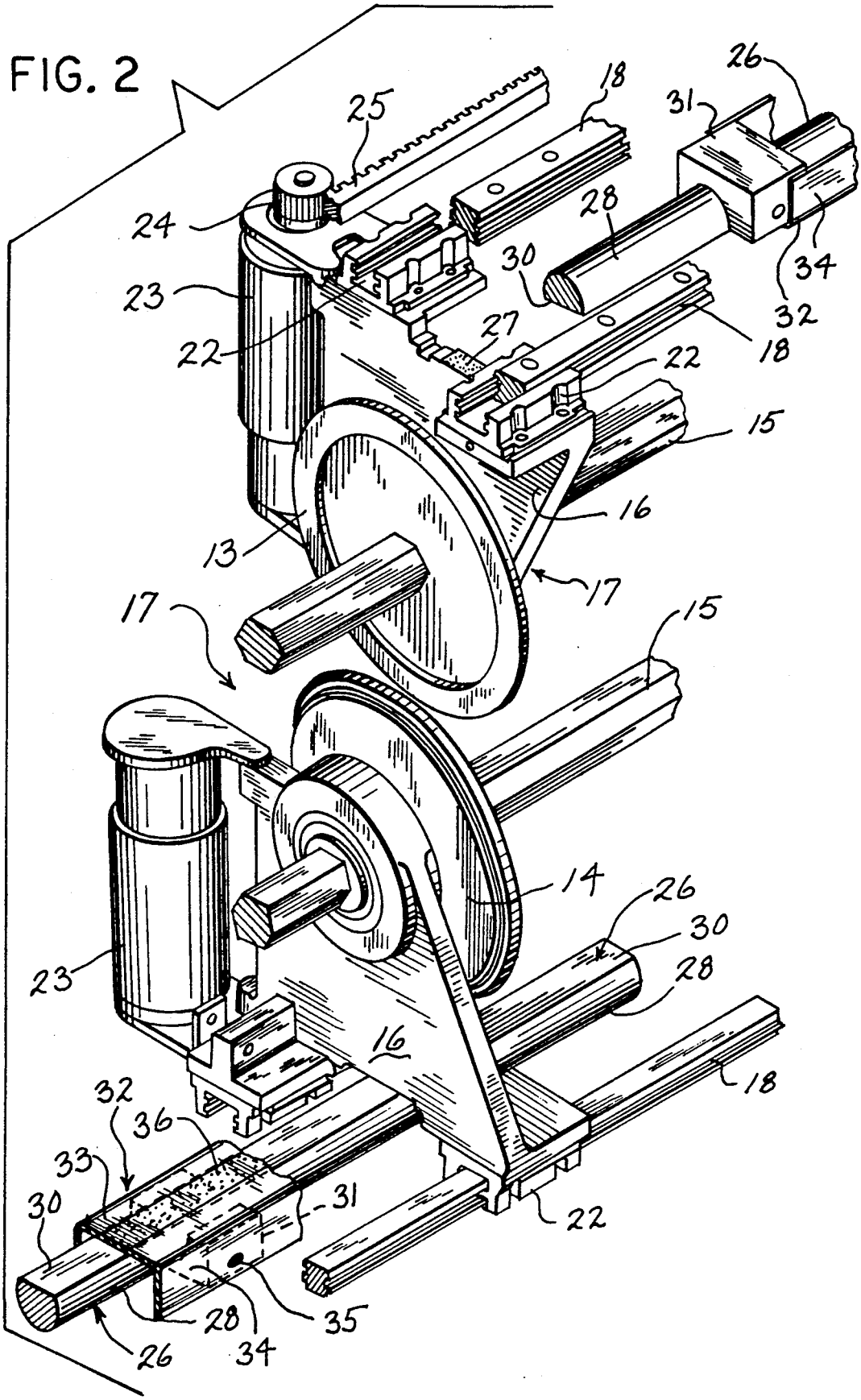
FIG. 2 is a detailed perspective view of one pair of upper and lower slitting heads of the apparatus shown in FIG. 1 showing further details of the lockdown apparatus of the present invention.

Referring initially to FIGS. 1 and 2, a slitter-scorer machine is utilized to provide longitudinal slits and score lines in a continuously advancing sheet 10 of corrugated paperboard or the like as the sheet travels generally horizontally between a plurality of pairs of laterally spaced scoring tools and slitting tools. Each pair of scoring tools includes an upper scoring tool 11 and a lower scoring tool 12 mounted adjacent the opposite surfaces of the sheet 10. Similarly, each pair of slitting tools includes an upper slitting tool 13 and a lower slitting tool 14 likewise mounted adjacent the opposite surfaces of the sheet. The edges of the scoring tools 11 and 12 are spaced slightly from one another by an amount less than the thickness of the sheet 10 to form a narrow generally V-shaped score line on opposite surfaces of the sheet. Each pair of slitting tools 13 and 14 has a cutting edge which overlaps slightly the cutting edge of the other tool forming the pair to slit the advancing sheet longitudinally. A plurality of pairs of scoring and slitting tools (e.g. 10 or more) are typically mounted laterally across the width of the machine and the width of the advancing sheet. The tools are separately positionable to establish score lines and slits wherever desired across the width of the sheet.

Each plurality of scoring or slitting tools 11-14 is coaxially mounted on its own drive shaft 15, each of which drive shaft extends across the full width of the machine for attachment to suitable drive means (not shown). Each of the tools 11-14 is also rotatably attached to a tool head support arm 16, such that the journalled connection between the tool and the support arm 16 also lies on the axis of the drive shaft 15. Thus, each combination of a scoring or slitting tool 11,12 or 13,14 and its associated support arm 16 comprises an individual tool head 17 which is movable on its drive shaft 15 laterally across the width of the machine. As previously indicated, each drive shaft 15 carries a plurality of tool heads 17.

Each plurality of tool heads carrying one coaxial group of identical upper or lower scoring tools 11 or 12, or upper or lower slitting tools 13 or 14, is supported for linear sliding movement along its drive shaft 15 on a pair of parallel linear bearings 18. The pair of linear bearings 18 for each group of tool heads 17 for the upper scoring tools 11 and upper slitting tools 13 are attached to a rigid upper box beam 20 comprising the major upper horizontal frame member for the slitter-scorer machine. Similarly, the pairs of linear bearings 18 for each tool head group including the lower scoring tools 12 and lower slitting tools 14 are attached to a rigid lower box beam 21 comprising the major lower horizontal frame member for the machine. Each tool head support arm 16 includes a pair of bearing pads 22 for sliding attachment to its related pair of linear bearings 18. Of course, each pair of linear bearings 18 lies parallel to its drive shaft 15, and all linear bearings are parallel to one another and to all other drive shafts.

To provide accurate score lines and precise slits in the advancing sheet 10, it is vitally important that the scoring and slitting tools be capable of being precisely positioned laterally across the sheet and each with respect to its mating tool comprising each pair of upper and lower tools 11 and 12 or 13 and 14. The edges of each cooperating pair of upper and lower scoring tools must be precisely aligned so the score lines on opposite sides of sheet are likewise aligned. Similarly, the overlapping cutting edges of each pair of slitting tools 13 and 14 must be maintained in precise cutting relationship to provide a smooth, clean slit. In addition, each of the mating upper and lower tool pairs must be able to be precisely positioned to provide the longitudinal slit or score line in the sheet in its proper position. Finally, when positioned, the tools must be held very securely against even the slightest linear displacement along their drive shaft and linear bearings. For example, in a typical slitter-scorer, linear movement of the tool head 17 along the bearing ways and drive shaft should be held to 0.0005 inch (0.013 mm) in either direction.

Each tool head 17 is driven along its linear bearings 18 and drive shaft 15 and precisely positioned by a small drive motor 23 attached to the support arm 16. Each drive motor drives a pinion gear 24 which cooperates with a rack 25 attached to one of the upper or lower box beams 20 or 21 and extending the full width of the machine. Thus, each of the four groups of tools 11–14 includes a separate rack 25 along which the common coaxially mounted tool heads may be individually laterally translated. The drive motors 23 may comprise DC servomotors which are microprocessor controlled to provide automatic and extremely accurate positioning.

Once the tool heads 17 are accurately positioned, they must be securely locked in position to provide both accurate mating of each opposed tool pair and the maintenance of precise lateral positioning of the tools with respect to the advancing sheet. In the previously identified prior art patent, each plurality of tool heads on a common drive shaft 15 utilized a lockdown apparatus comprising an elongate cam 26 extending the full width of the machine and parallel to the drive shaft, linear bearings, and rack, and adapted to cooperate with high bearing friction locking surfaces 27 on each of the tool head support arms 16. The cam 26 has a substantially cylindrical outer surface portion 28 which is interrupted by an axially extending flat 30. The cam 26 for each lockdown apparatus is supported for rotation on its axis in a series of cam support bearings 31 which are attached to either the upper box beam 20 or lower box beam 21, depending on whether the lockdown apparatus is for an upper tool array or a lower tool array. Operator means (not shown) are associated with each cam 26 to rotate the same between an unlocked position in which the axial flat 30 is disposed generally parallel to the locking surfaces 27 and spaced therefrom, to a locked position in which the cylindrical outer surface portion 28 of the cam 26 is in locking engagement with the high friction locking surfaces 27. In a typical slitter-scorer, each tool head 17 is securely locked in position against a lateral force of at least 200 lbs. (91 kg) tending to displace the head along the axis of its drive shaft 15.

If each elongate cam 26 can be supported to rotate on its axis, but be simultaneously held against any axial movement, the prior art lockdown apparatus will operate satisfactorily. However, the cam support bearings 30 provide no support against axial displacement of the cam and the typical end bearings (not shown) used to support the cam cannot be constructed to completely preclude axial movement of the cam. When the prior art cam is in its locked position in direct locking engagement with each of the locking surfaces 27 on a plurality of tool heads mounted on a common drive shaft, any axial movement of the cam shaft will inherently carry the locked tool heads with it. It has been found that the typical supporting end bearings cannot be constructed with tight enough tolerance to eliminate axial movement of the cam and that such axial movement increases with wear. In addition, repeated locking engagement between the cylindrical surface portion 28 of the cam 26 and the locking surfaces 27 on the tool heads results in wear which in time adversely affects the locking force with which the tool heads are held. This may require undesirable periodic shimming or other adjustment, or even eventual replacement of the parts.

In accordance with the present invention, a unique flexible membrane 32 is interposed between each cam 26 and the locking surfaces 27. The flexible membrane may be readily fixed against movement in the direction of the axis of the cam 26 and the membrane likewise eliminates direct wearing contact between the cam and the locking surfaces as the former moves between its unlocked and locked positions. Thus, the membrane permits only indirect engagement between the cam and the locking surfaces such that the cam 26 engages one surface of the membrane and forces the opposite surface thereof into engagement with the locking surfaces 27. In addition, the membrane 32 may be constructed to substantially enclose the cam 26 and, as a result, the relatively movable contacting surfaces between the cam and the membrane may be lubricated to reduce wear. Any axial movement of the cam because of lack of axial restraint in the supporting bearings will cause the cam to slide along the surface of the membrane with which it is in direct engagement, but the fixed position of the membrane will maintain secure locking engagement with the locking surfaces 27 on the tool heads 17.

Figure 3:
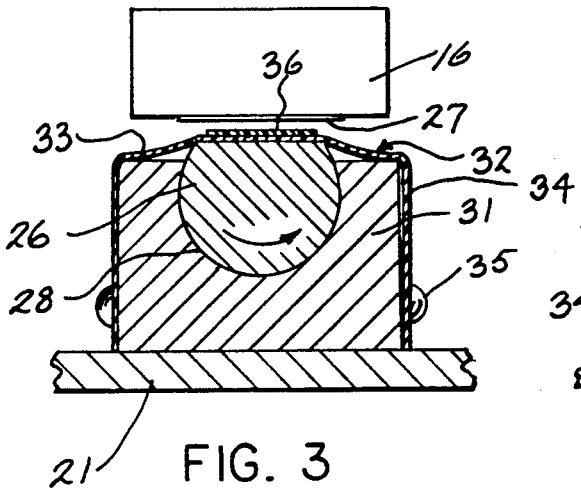
FIG. 3 is an enlarged sectional detail of a portion of line 3—3 of FIG. 1 showing one lockdown device in its unlocked position.
Figure 4:
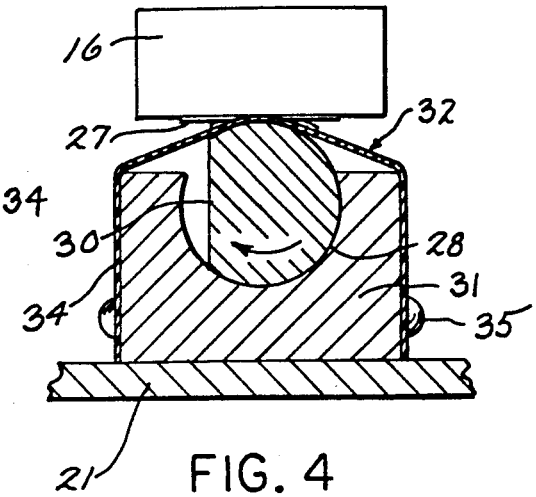
FIG. 4 is an enlarged sectional detail, similar to FIG. 3, showing the lockdown apparatus in its locked position.

Referring also to FIGS. 3 and 4, the flexible membrane 32 comprises a continuous sheet of any suitably tough and flexible material, such as stainless steel, which may be formed to overlie the cam and suitably bent to enclose the opposite sides thereof as well. Thus, the membrane includes a generally horizontally disposed engaging surface 33 which is disposed directly between the cam 26 and the locking surfaces 27 and integral lateral edge surfaces 34 which may be wrapped around the edges of the cam support bearings 31 and secured thereto with suitable spaced fasteners 35. The cam support bearings 31, as previously indicated, are rigidly secured to one of the upper or lower box beams 20 or 21. In this manner, the membrane 32 is secured against or with respect to any axial movement of the cam 26. Because there is no direct sliding contact between the cam and the locking surfaces 27, the side of the engaging surface 33 of the membrane 32 in contact with the locking surfaces 27 may be provided with a high friction surface 36 to enhance locking engagement.

The membrane 32 is preferably sized and attached to maintain contact with the axial flat 30 on the cam 26 when the latter is in the unlocked position. With the membrane 32 substantially enclosing the cam and cam support bearings 31, all of the various sliding bearing surfaces therein may be suitably lubricated and the lubricant will be contained against escape and possible contamination of the sheet 10.

In a variation of the rotary cam 26, the outer cam surface may be non-circular and formed with a continuous cam surface which provides a smooth transition from a smaller radius unlocked portion to a larger radius locked portion. In this variation the cam could be operated to rotate in one direction or back and forth as in the depicted embodiment.

Figure 5:
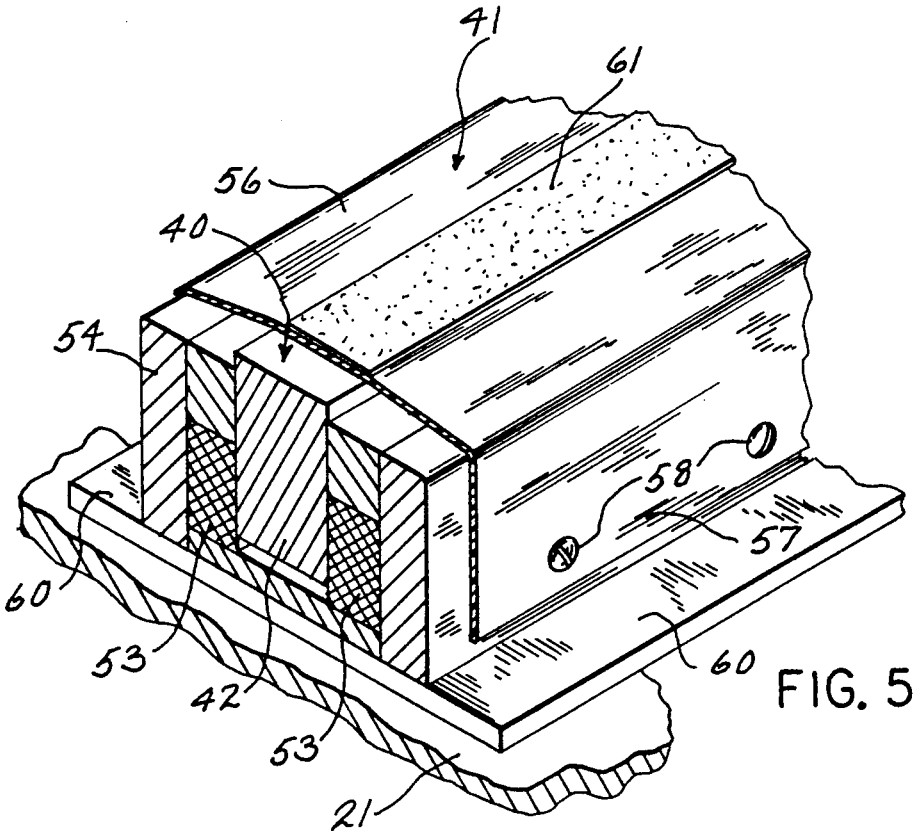
FIG. 5 is a detailed perspective view of the presently preferred embodiment of the lockdown device of the present invention.
Figure 6:
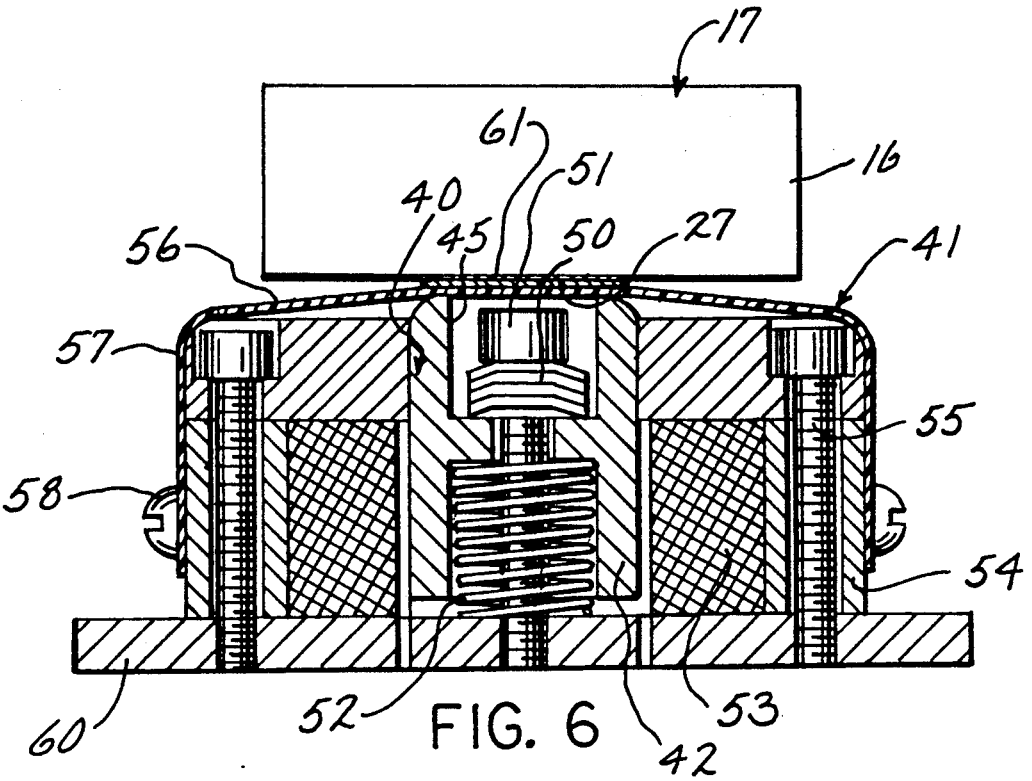
FIGS. 6 and 7 are sectional views of the lockdown apparatus of FIG. 5 showing various features of the internal construction and showing, respectively, the device in its locked and unlocked positions.
Figure 7:
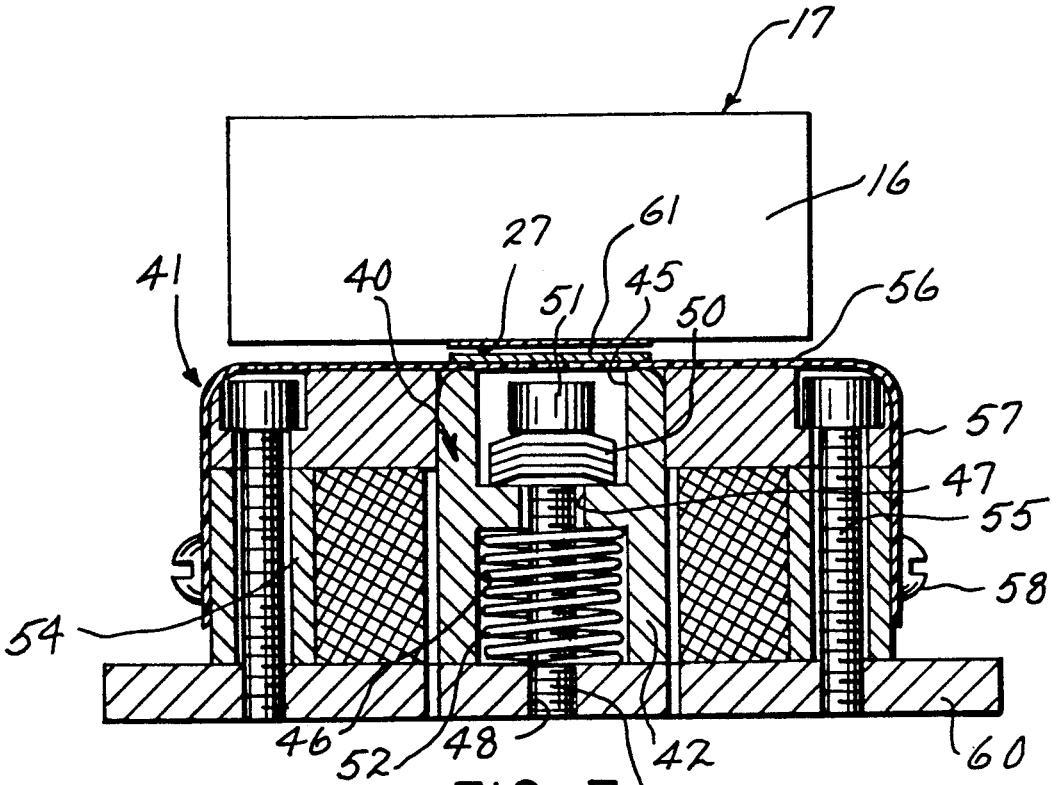

In a presently preferred embodiment of the present invention shown in FIGS. 5–7, the elongate rotary cam 26 is replaced with an elongate locking bar 40 which is supported for reciprocal movement into and out of locking engagement with the locking surfaces 27 on the tool heads 17. As in the previously described embodiment, a flexible membrane 41, substantially identical to membrane 32, is disposed between the locking bar 40 and the locking surfaces 27. In a preferred construction, the locking bar is resiliently biased into its locked position and includes separate means for overcoming the locking bias and moving the locking bar into an unlocked position.

In the lockdown apparatus of FIGS. 5–7, the locking bar 40 comprises the armature 42 of a solenoid. The armature 42 is attached to a base plate 43 for relative reciprocal movement with respect thereto to and from its locked positions by a series of mounting bolts 44 spaced along the length of the armature. At the position of attachment of each mounting bolt 44, the armature 42 is provided with an outer counterbore 45 and an axially aligned inner counterbore 46 interconnected by a through bolt hole 47. Each mounting bolt 44 threadably engages a suitably tapped hole 48 in the base plate 43 with an array of Belleville washers 50 held in the outer counterbore 45 by the bolt head 51 and a large coil spring 52 held in compression in the inner counterbore 46. The combined force of all the coil springs 52 associated with the mounting bolts 44 spaced along the entire length of the armature is sufficient to overcome the bias of the Belleville washer arrays 50 and to force the locking bar armature into its locked position in engagement with the locking surfaces 27 on the tool heads (with the flexible membrane 41 interposed directly therebetween). Thus, the system is devised such that the armature is normally biased into its locked position and may be moved into its unlocked position by actuation of the solenoid to overcome the bias of the coil springs 52. A wire solenoid coil 53 is held in a pair of coil mounting members 54, one on each side of the armature, to support the coil to surround the armature in a known manner. Each of the coil mounting members 54 is attached to the base plate 43 with a series of bolts 55. The flexible membrane is constructed and disposed to substantially enclose the solenoid in a manner similar to the cam embodiment of FIGS. 1–4. Thus, the membrane 41 includes a horizontally disposed engaging surface 56 and an integral pair of opposite lateral edge surfaces 57 by which the membrane is attached to the coil mounting members 54 with suitable spaced fasteners 58. The base plate 43 includes integral laterally extending mounting flanges 60 by which the entire locking bar assembly may be attached to one of the upper or lower box beams 20 or 21.

The locking bar 40 comprising the armature 42 of the solenoid cannot be adequately constrained against longitudinal movement (in a direction corresponding to axial movement of the cam 26 of the previously described embodiment). However, with the flexible membrane 41 interposed between the locking bar 40 and the locking surfaces 27 on the tool heads in the locked position of FIG. 6, the locking bar may move longitudinally along the inside surface of the flexible membrane, but the membrane will not move therewith and remain locked and stationary.

The outside of the engaging surface portion 56 of the membrane 41 may likewise be provided with a high friction surface 61 to enhance locking contact with the locking surfaces 27 on the tool heads. An important advantage of this lockdown construction over that of the rotating cam in FIGS. 1–4 is that there is no sliding motion between the locking bar and the flexible membrane and, therefore, no relative wear or need to lubricate the engaging surfaces. The solenoid is constructed such that actuating current through the coil 53 causes the armature 42 to move against the bias of the coil springs 52, toward the base plate 43, and out of engagement with the tool heads. The Belleville washers 50 cushion the force of the coil springs 52 when the solenoid is deactivated and the locking bar is returned to its locked position. The forces required to maintain a plurality of tool heads in the locked position is obviously substantial and, without the intermediate Belleville washer arrays 50, the return force of the coil springs 52 will break the mounting bolts or otherwise damage the lockdown apparatus.

The lockdown apparatus of each of the two embodiments described herein may be utilized in an identical construction for each of the four lockdowns required in a typical slitter-scorer. Rotational actuation of the cam operated lockdown apparatus of FIGS. 1–4 may utilize operators which are identical to those described in the previously identified U.S. Pat. No. 4,627,214. Another advantage of the lockdown apparatus of FIGS. 5–7 is that the electrically operated solenoid does not require a mechanical operating linkage as described in that patent and utilized with the rotary cam embodiment. It will be seen that the flexible membranes 32 and 41 of the two disclosed embodiments provide a relatively simple but extremely effective means for absolutely precluding movement of the tool heads because of axial movement of the locking member once the heads are locked in position. In addition, both embodiments eliminate relative wear between the locking surfaces on the tool heads and the engaging locking members. In the rotary cam embodiment of the present invention, where relative sliding contact between the cam and one surface of the flexible membrane still occurs, the engaging surfaces may be suitably lubricated to substantially reduce wear. In both embodiments, the substantially continuous enclosing membrane contains and prevents the egress of lubricates or any other contaminants associated with the movable locking members.

Various modes of carrying out the present invention are contemplated as being within the scope of the following claims particularly pointing out and distinctly claiming the subject matter which is regarded as the invention.

We claim:

1. A lockdown apparatus for releasably locking an operating mechanism in a selected position, which mechanism is translatable in a linear path along a supporting track to any of a plurality of selected positions, said apparatus comprising:

a locking surface on said mechanism, said locking surface fixed in a selected position against movement along said linear path;

a rigid elongate locking bar supported for reciprocal movement in a direction normal to said linear path and positioned parallel to and generally coextensive with said linear path and adjacent said locking surface in any selected position of said mechanism;

said locking bar being movable between an unlocked position spaced from said locking surface and a locked position in operative engagement with said locking surface;

a flexible membrane positioned between said locking surface and said locking bar, said membrane being fixed against movement in the direction of said linear path and flexurally movable in response to direct engagement by said locking bar into direct locking engagement with said locking surface in the locked position of said locking bar;

said locking bar being movable along said linear path in said locked position with respect to said membrane and said locking surface; and, a solenoid device for moving said locking bar between its unlocked and locked positions, said device including a rigid supporting base fixed against movement in the direction of said linear path means for connecting said locking bar to said supporting base including resilient means for biasing said locking bar into the locked position interposed therebetween;

means for overcoming the bias of said resilient means and moving said locking bar into the unlocked position; and means for attaching said flexible membrane to said supporting base.

2. The apparatus as set forth in claim 1 wherein said locking bar comprises the armature of said solenoid device, and said resilient means comprises a plurality of coil springs disposed between said locking bar and said support base.

3. The apparatus as set forth in claim 2 wherein actuation of said solenoid device causes said locking bar to move against the bias of said coil springs to the unlocked position.

* * * * *